US005201413A

United States Patent [19]

DeBlasio et al.

[11] Patent Number: 5,201,413

[45] Date of Patent: * Apr. 13, 1993

[54] DUAL CIGARETTE CARTON WITH SEPARABLE OR DIVISIBLE LABEL CONTAINING UNIVERSAL PRODUCT CODE

[75] Inventors: James A. DeBlasio; Susan J. A. Douglas, both of Midlothian; Johnny L. Miller; Xuan M. Pham, both of Richmond; Robert E. Talley, Chester, all of Va.

[73] Assignee: Philip Morris Incorporated, New York, N.Y.

[ * ] Notice: The portion of the term of this patent subsequent to Aug. 25, 2009 has been disclaimed.

[21] Appl. No.: 792,617

[22] Filed: Nov. 15, 1991

Related U.S. Application Data

[63] Continuation-in-part of Ser. No. 774,529, Oct. 8, 1991, Pat. No. 5,141,106.

[51] Int. Cl.[5] ..... B65D 85/10

[52] U.S. Cl. ..... 206/256; 206/264; 206/273; 206/459.1; 40/312; 53/448

[58] Field of Search ..... 206/256, 273, 459, 264; 40/312; 53/448

[56] References Cited

U.S. PATENT DOCUMENTS

| | | | |
|---|---|---|---|
| 276,171 | 4/1883 | Fraser . | |
| 1,256,965 | 2/1918 | Williams . | |
| 1,863,190 | 6/1932 | Coulapides . | |
| 2,009,835 | 7/1935 | Burke . | |
| 2,046,484 | 7/1936 | Ringler | 206/256 |
| 2,109,583 | 3/1938 | Bennett . | |
| 2,565,509 | 8/1951 | Marcin . | |
| 2,605,897 | 8/1952 | Rundle . | |
| 2,697,544 | 12/1954 | Morand . | |
| 2,871,080 | 1/1959 | Shelly . | |
| 2,895,601 | 7/1959 | Krukonis . | |
| 2,959,338 | 11/1960 | Thurston . | |
| 2,984,340 | 5/1961 | Carmichael . | |
| 3,071,244 | 1/1963 | Doran . | |
| 3,082,929 | 3/1963 | Aquino et al. . | |
| 3,086,650 | 4/1963 | Chapman et al. . | |
| 3,113,673 | 12/1963 | Stein . | |
| 3,144,190 | 8/1964 | Holt et al. . | |
| 3,163,351 | 12/1964 | Borgardt . | |
| 3,221,876 | 12/1965 | Currie . | |
| 3,226,010 | 12/1965 | Rogers, Jr. . | |
| 3,447,733 | 6/1969 | Smith et al. . | |
| 3,503,568 | 3/1970 | Galley . | |
| 3,536,246 | 10/1970 | Rosen . | |
| 3,596,758 | 8/1971 | Phillips, Jr. et al. . | |
| 3,721,335 | 3/1973 | Grant . | |
| 3,752,308 | 8/1973 | Begemann . | |
| 3,759,379 | 9/1973 | Werth . | |
| 3,809,227 | 5/1974 | Begemann . | |
| 4,424,658 | 1/1984 | Focke . | |
| 4,441,611 | 4/1984 | Sommariva . | |
| 4,485,926 | 12/1984 | Lenzmeier . | |
| 4,631,900 | 12/1986 | Mattei et al. | 53/448 |
| 4,669,611 | 6/1987 | Flaherty | 206/459 X |
| 4,738,359 | 4/1988 | Phillips, Jr. | 206/256 |
| 4,928,817 | 5/1990 | Focke | 206/256 |
| 4,932,534 | 6/1990 | Focke et al. | 206/273 X |

FOREIGN PATENT DOCUMENTS

| | | | |
|---|---|---|---|
| 1101199 | 10/1955 | France | 40/312 |
| 358560 | 10/1931 | United Kingdom . | |

*Primary Examiner*—Bryon P. Gehman

*Attorney, Agent, or Firm*—Karen G. Horowitz; Jeffrey H. Ingerman

[57] ABSTRACT

A dual cigarette carton formed from two substantially identical single cigarette cartons. A label bearing indicia encoded for the automatic pricing of the dual carton is placed across adjacent coplanar walls of the two single cartons. The indicia are positioned such that they are rendered unreadable by automatic equipment when the two single cartons are separated for individual sale. Each single carton further includes indicia encoded for the automatic pricing of a single carton, the indicia being positioned such that they are not readily visible when the single cartons are connected to form a dual carton.

61 Claims, 6 Drawing Sheets

FIG. 1
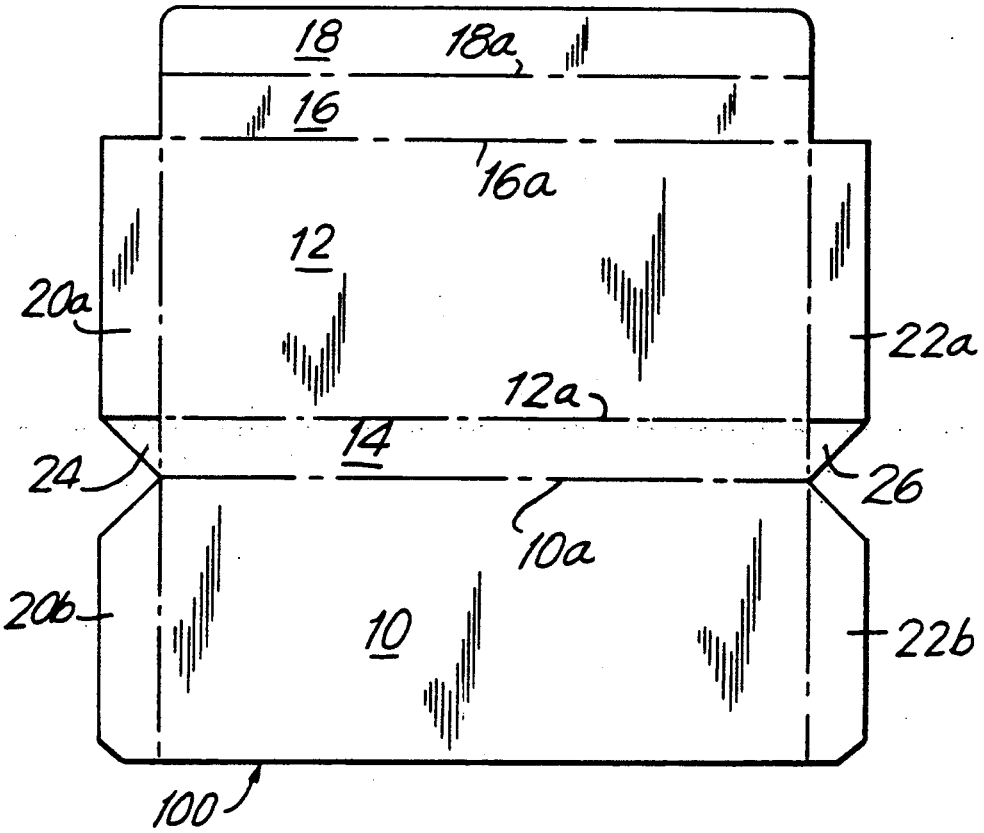
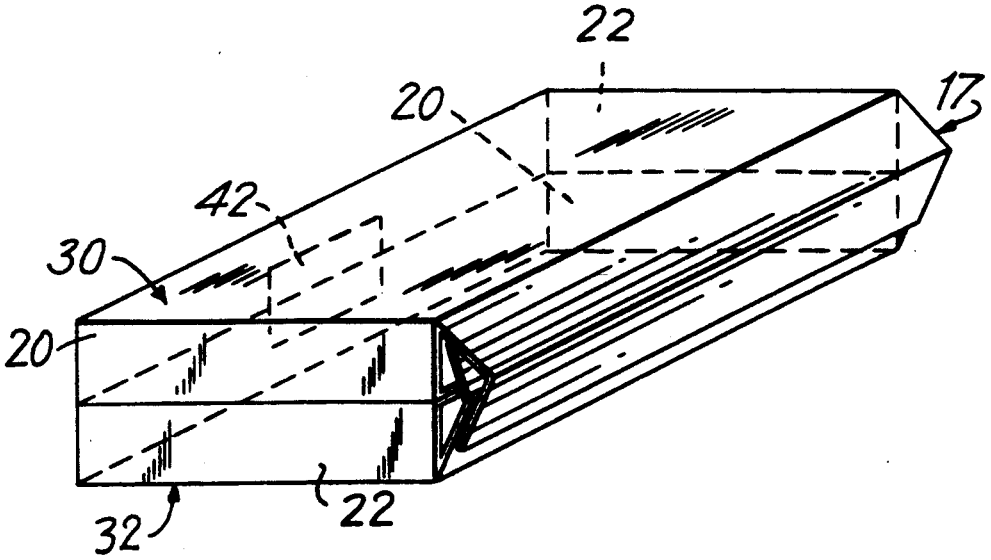
FIG. 3

FIG. 6
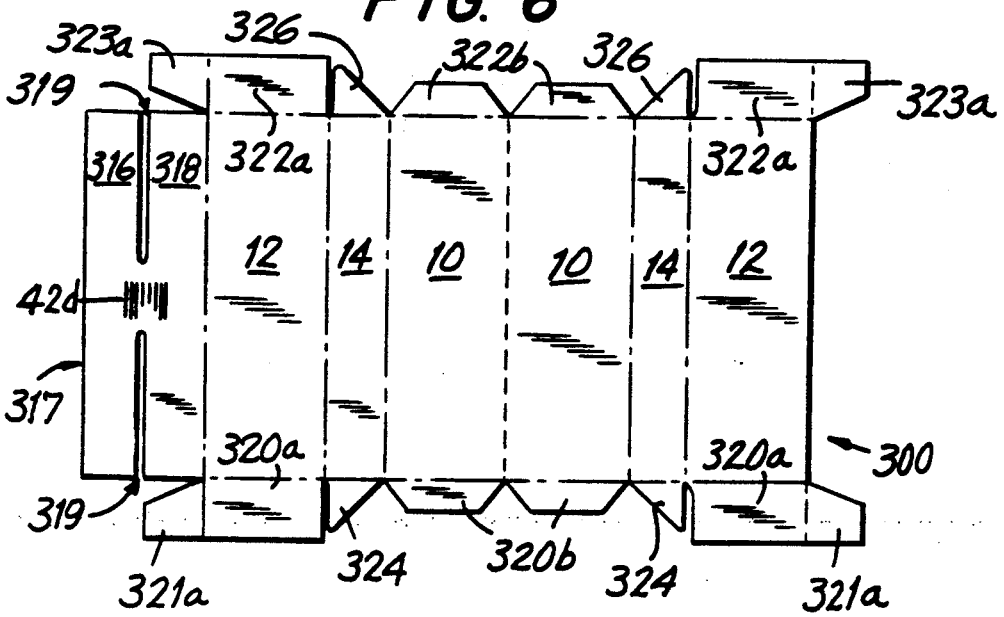
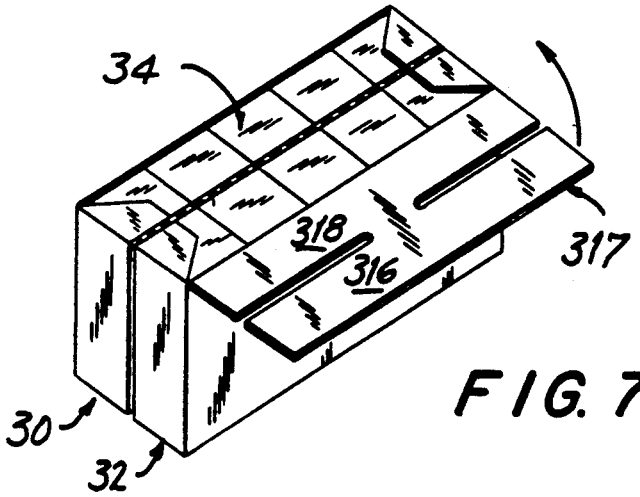
FIG. 7
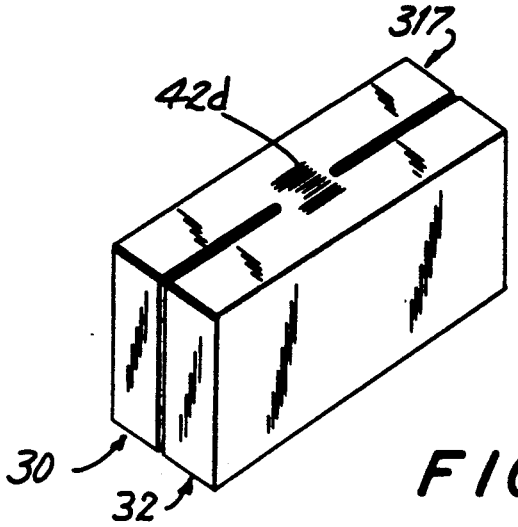
FIG. 8

FIG. 9
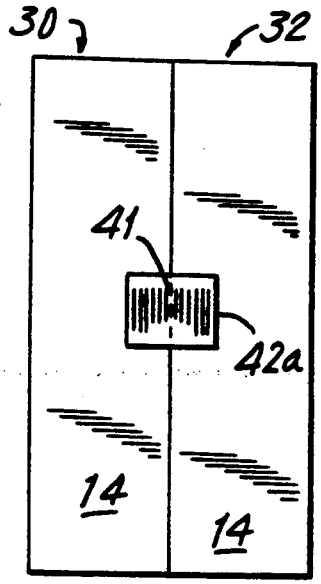
FIG. 10
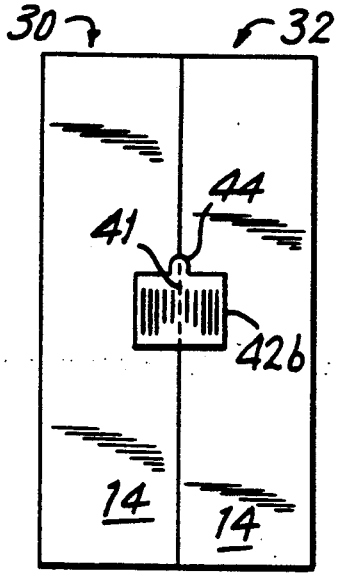
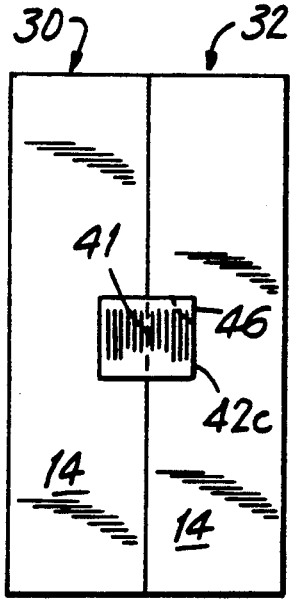
FIG. 11
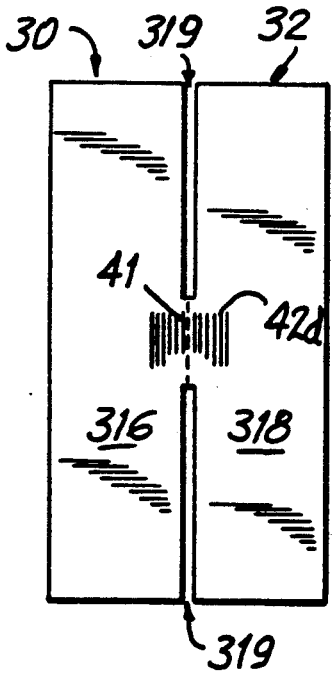
FIG. 12

DUAL CIGARETTE CARTON WITH SEPARABLE OR DIVISIBLE LABEL CONTAINING UNIVERSAL PRODUCT CODE

CROSS REFERENCE TO RELATED APPLICATION

This application is a continuation-in-part of copending, commonly-assigned U.S. Pat. application Ser. No 07/774,529, filed Oct. 8, 1991, now U.S. Pat. No. 5,191,106 which is hereby incorporated by reference in its entirety.

BACKGROUND OF THE INVENTION

The present invention relates to the use of a label bearing indicia encoded for automatic pricing to connect two separate cartons, in particular, cigarette cartons, to form a combined dual carton, the indicia being positioned such that the code is rendered unreadable when the two cartons are separated.

Cigarette packs (which usually contain twenty cigarettes) are generally rectangular in shape, having front and back long walls and two short side walls. Cigarette cartons typically contain two rows of five cigarette packs per row (each row arranged so that the front long walls of the packs are in the same plane and the back long walls are in a parallel plane spaced from the front long walls), and are generally known in the art as ten-pack cartons. Such cigarette cartons are generally filled with cigarette packs by the manufacturer, temporarily closed (e.g., by folding the top flap of the carton over the box and releasably securing the flap in the closed position), and shipped to various distributors. The distributors generally open the cartons, after they are received, to apply any tax stamp that may be required by the jurisdiction in which they operate to the individual cigarette packs inside the cartons. Such procedures are commonly automated to reduce time, cost, and labor through the use of specially designed machines for applying tax stamps. Tax-stamping machines have been developed to open the cartons, apply the stamps, and finally seal the cartons for distribution. Such machines are generally commercially available, and are well known in the art. These machines have been developed for standard ten-pack cigarette cartons. A typical tax-stamping machine is model FUSON manufactured by Meyercord Co. of 365 East North Avenue, Carol Stream, Ill. 60187.

Single row cigarette cartons which are dimensioned to contain one row of five cigarette packs (each pack usually containing twenty cigarettes, the packs arranged so that the front long walls of the packs are in the same plane and the back long walls are in a parallel plane spaced from the front long walls), i.e., five-pack cartons, are also known in the art. However, although machinery exists for manufacturing such cartons, machinery does not exist for stamping the cigarette packs contained in five-pack cartons. Consequently, such single row cartons must either be hand-stamped (as is done currently) or would have to be secured together in pairs to be run through the existent tax-stamping equipment. To assure that the tax stamp is properly registered, the means for securing the cartons must be strong enough to keep the cartons together such that they are not sheared apart by the vertical rollers of the tax-stamping machines which roll along the vertical walls of the cartons to transfer the cartons between the various stages of the process.

If two single row cartons are to be secured together, the means for securement must allow for later separation of the cartons, if desired, by the retailer or consumer. For marketing purposes, once separated, the two cartons should have little or no trace of the means for securement which would disfigure the outward appearance of the cartons.

In order to facilitate automatic pricing, indicia encoded for automatic pricing of the dual carton are generally included on an outer face of the cartons to be scanned by automatic pricing equipment. Each carton is also usually priced for individual sale. The use of such automatic pricing indicia often presents several difficulties. When two narrow cartons, each coded for individual sale, are connected, an automatic scanner may scan both prices thereby charging the price of two cartons If the price of the combined carton is to be less than the price of two cartons sold together, the customer may be overcharged if the automatic scanner scans both price codes instead of the reduced price. Furthermore, if the automatic scanner only scans one price code, the retailer/wholesaler has undercharged. If a label bearing indicia coded for the price of the combined carton is placed on the combined carton, the label may still be readable if the cartons are separated for individual sale and the customer may be charged the price of the combined carton instead of the individual carton The scanner may also register both the combined price and the individual price, thereby overcharging the customer.

SUMMARY OF THE INVENTION

It is therefore an object of this invention to provide a means for securing two narrow cigarette cartons together to have the combined dimensions of a dual cigarette carton such that the two cartons do not move relative to one another while being transferred throughout the tax-stamping machinery.

It is also an object of this invention to provide a means for making a clean separation between the two narrow cartons, if desired, for sale as individual cartons instead of as a dual carton composed of two narrow cartons.

It is a further object of this invention to connect the two narrow cartons such that the price coding indicia of the individual cartons are not readily visible to be scanned by automatic equipment.

It is another object of the invention to provide a label bearing price coding indicia for sale of the combined carton.

It is yet a further object of the invention to print or position such a label such that the price coding indicia are destroyed upon separating the cartons for individual sale.

These and other objects of the invention are accomplished in accordance with the principles of the invention by providing a label bearing price coding indicia, such as Universal Product Code (U.P.C.) indicia, positioned across two adjacent, coplanar walls of two single cartons. The label serves as a means for connecting the two cartons and also as a means for automatic pricing of the dual carton. The price coding indicia for the dual carton are positioned across the two cartons such that the price coding is rendered unreadable by automatic equipment once the cartons are separated for individual sale. The price coding indicia of the individual cartons are positioned such that the indicia are not readily visible until the cartons are separated for individual sale.

BRIEF DESCRIPTION OF THE DRAWINGS

Further features of the invention, its nature, and various advantages will be more apparent from the accompanying drawings and the following detailed description of the preferred embodiments, wherein like reference characters represent like elements throughout, and in which:

FIG. 1 is a plan view of an illustrative carton blank for a five-pack carton in accordance with this invention;

FIG. 3 is an isometric view of two five-pack cartons before tax-stamping, connected with a label bearing price coding indicia affixed to the external sides of the cartons to thereby connect the cartons;

FIG. 6 is a plan view of an illustrative carton blank for forming the ten-pack carton shown in FIG. 12;

FIG. 7 is an isometric view of a carton formed from the blank of FIG. 6, with the lid open;

FIG. 8 is an isometric view similar to that of FIG. 7, but with the lid closed;

FIG. 9 is a bottom plan view of two five-pack cartons connected with a label bearing price coding indicia affixed across the bottom walls of the cartons;

FIG. 10 is a bottom plan view similar to that of FIG. 9, but showing a label having a grip tab;

FIG. 11 is a bottom plan view similar to that of FIG. 9, but showing a label having a lift-up corner;

FIG. 12 is a top plan view of two five-pack cartons connected with a label bearing price coding indicia which is an integral part of the two cartons and bridges the two cartons;

DETAILED DESCRIPTION OF THE INVENTION

Figure 4:
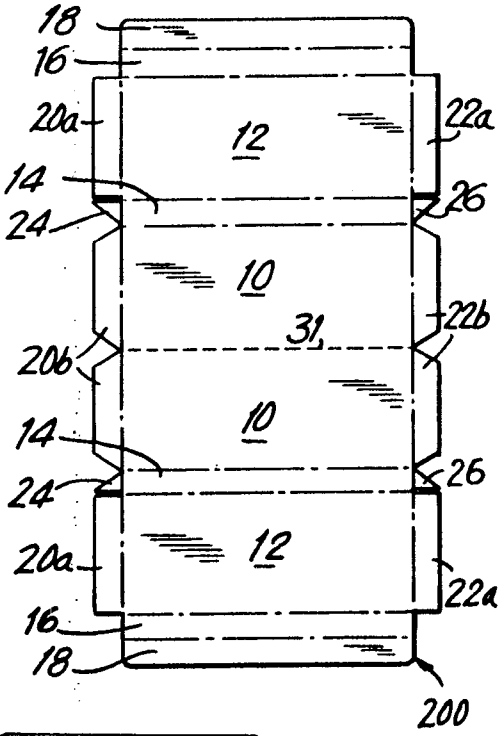
FIG. 4 is a plan view of an illustrative carton blank for forming two five-pack cartons joined by a perforated line in accordance with this invention.

As shown in FIG. I, blank 100, used for forming a carton adapted to hold one row of five cigarette packs (each pack usually containing twenty cigarettes), i.e., a five-pack, has a plurality of fold lines represented by broken lines. Blank 100 is preferably formed from a substantially rigid material such as paperboard or cardboard. Each relatively large panel 10 and 12 of blank 100 is substantially five times the width of a long wall of the cigarette pack to be enclosed therein. As used herein, a standard cigarette pack is defined as any pack commonly used for holding a predetermined number of cigarettes, and generally having front and back long walls connected by two short side walls. When blank it is folded along respective fold lines **10*a* and 12*a*, panel 10 becomes the front wall of the carton and panel 12 becomes the rear wall of the carton. Joining panels 10 and 12 is bottom panel 14, which forms the bottom wall of the carton when the blank is folded into a carton. Panel 16, having substantially the same dimensions as bottom panel 14, extends from rear panel 12. After walls 10 and 12 are assembled, panel 16 is folded along fold line 16*a* over the top of the carton to extend between walls 10 and 12 of the carton. Extension panel 18 joins panel 16 along a fold line 18*a*. Additional fold lines are shown in FIGS. 1, 4 and 6** as broken lines but are not identified with individual reference characters.

Panels 16 and 18 together form a top and tuck-in flap 17. When the carton is formed and ready for distribution to consumers, extension panel 18 lies substantially parallel to front wall 10, preferably inside the carton, and panel 16 is folded over the top of the carton towards front wall 10. Side panels **20*a* and 20*b* are folded one over the other to form a side wall 20 of the carton. Side panels 22*a* and 22*b* are folded in a similar fashion to form side wall 22. The "a" panel is preferably folded over the "b" panel. Tabs 24 and 26 are preferably folded perpendicular to panel 14 before the side panels are folded and will eventually lie substantially parallel to side walls 20 and 22, respectively. The distance between panels 10 and 12** of the completed carton is substantially the same as the distance between the front and back long walls of the enclosed cigarette pack.

Figure 2:
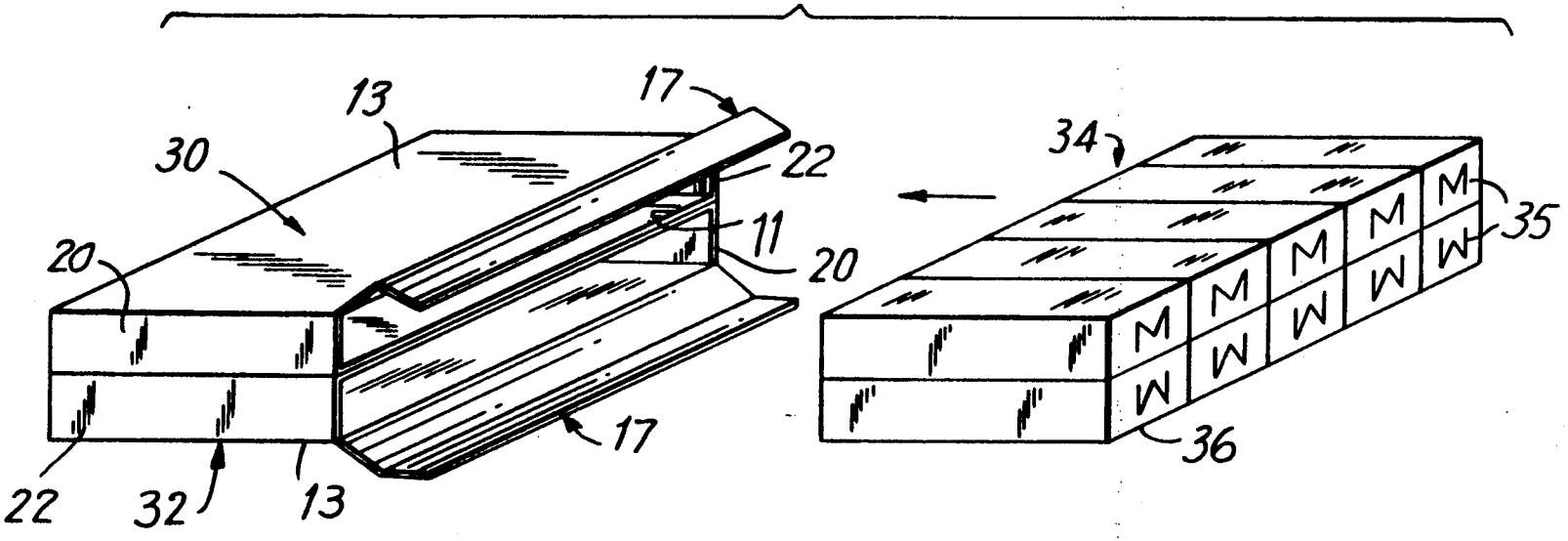
FIG. 2 is an exploded isometric view of two five-pack cartons, each constructed from a blank similar to that shown in FIG. 1, connected together in accordance with this invention to form, once connected, a ten-pack carton, as illustrated prior to insertion into the cartons.

FIG. 2 reveals two five-pack cartons 30, 32 connected along their front walls 10, hereinafter referred to as interior walls 11, prepared for insertion of a bundle 34 of ten cigarette packs 36. Rear walls 12 remain visible after connection of cartons 30, 32, and hence are hereinafter referred to as exterior walls 13. Flaps 17, which are formed from panels 16 and 18 of each blank 100 which forms cartons 30, 32, are opened such that the interiors of cartons 30, 32 are readily accessible for insertion of bundles 34. Because the "a" panels of blank 100 are preferably folded over the "b" panels, the free edge of each of the "a" panels faces inwardly, i.e., the free edges lie adjacent interior walls 11, when cartons 30, 32 are joined. In this configuration, the free edges of the "a" panels are not readily accessible and thus are relatively safe from being accidentally lifted from their place adjacent the "b" panels.

Packs 36 are preferably arranged in two rows of five packs per row with the short walls of adjacent packs facing each other and the long walls of the packs arranged in parallel planes such that the front walls of each row are in a first single plane and the rear walls of each row are in a second single plane spaced from the first single plane. The outer faces of packs 36 preferably bear printed matter 35, such as the brand name, a list of the contents, etc., such matter printed such that the pack has a front face and a rear face. An example of such printed matter 35 being the letter "M", the bottom of which is positioned towards the front face of the pack 36. When a consumer opens a cigarette carton, it is desirable for the front face of the cigarette packs inside the carton to face the consumer. It is therefore desirable to arrange cigarette packs 36 in cartons 30, 32 such that the front faces of the packs face each other and hence lie adjacent interior walls 11 once the packs are positioned in their respective cartons.

Figure 5:
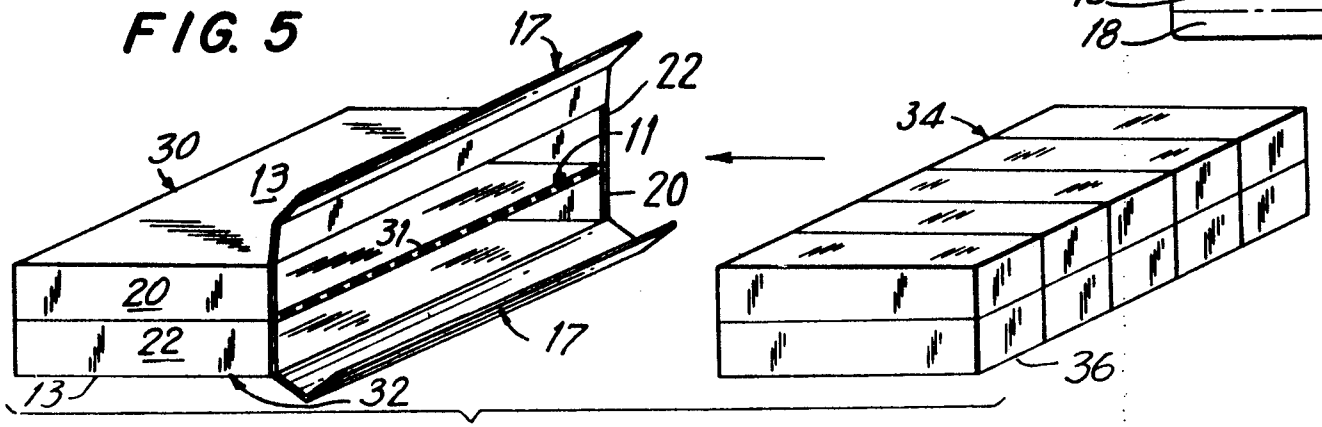
FIG. 5 is an exploded isometric view similar to that of FIG. 2 but with the blank of FIG. 4.

As shown in FIG. 4, cartons 30, 32 may be formed from a single blank 200. Each half of blank 200 resembles blank 100, with like reference characters representing like elements, and broken lines representing fold lines. The substantially identical halves of blank 200 are connected by a line of weakness 31, preferably a perforated line. Each half is individually folded to form a separate, five-pack carton. The blank is additionally folded along line 31 so that walls is lie against one another, facing each other. The completed combined cartons may be seen in FIG. 5, which is a view similar to that of FIG. 2 (with like reference characters representing like elements) except the cartons are joined along a perforated line formed in the blank which forms the cartons.

A modified single blank 300, shown in FIG. 6, may also be used to form cartons 30, 32. Blank 300 resembles blank 200, but there are differences as will be noted. Side panels 320*a*, 320*b*, 322*a* and 322*b* are substantially the same as side panels 20*a*, 20*b*, 22*a*, and 22*b* of blank 200, except the corners of the side panels of blank 300 are cut differently. Similarly, tabs 324 and 326 of blank 300 are substantially the same as tabs 24 and 26 of blank 200, except the corners are cut differently. Blank 300 further includes additional tabs 323*a* and 321*a* extending from side panels 322*a* and 320*a*, respectively.

A further difference between blank 200 and blank 300 is the construction of the panels which are folded to form the top walls of the cartons. Instead of having two top and tuck-in flaps 17, such as formed from panels 16 and 18 of blank 200, blank 300 has a single top wall 317 formed from two panels 316 and 318. Top wall 317 has two slits 319 which divide the wall into the panels 316 and 318, and which each terminate at label 42*d* which bridges across and joins panels 316 and 318. A line of weakness (not shown) such as described above, may also be included, joining slits 319. Label 42*d* will be described in further detail below. Panel 316 may have an extension panel (not shown) similar to extension panel 18 of blank 100.

Panel 300 is folded in substantially the same manner as panel 200 is folded. FIG. 7 shows blank 300 formed into cartons 30, 32, with the top wall 317 not yet folded over the tops of the cartons. Cigarette bundle 34 has already been placed inside the formed cartons. FIG. 8 shows the completed, closed cartons 30, 32, after top wall 317 has been folded over the tops of the cartons.

An illustrative carrier means bearing price coding indicia, hereinafter referred to as label 42, is shown joining two five-pack cartons, in FIG. 3. Label 42 utilizes a carrier means such as mylar or paper, which bears an either permanent or releasable pressure-sensitive adhesive. Releasable pressure-sensitive adhesive is herein defined as any adhesive known in the art, which, preferably, is clear, has no taste or odor, and does not cause fiber pull of the carrier means or leave a tacky residue once the surfaces joined by the adhesive are separated (e.g., any adhesive known in the art which provides a strong bond between surfaces but once the surfaces are pulled apart, the bonds of the adhesive are broken and the adhesive is no longer tacky). The selected adhesive should be sufficiently strong to hold the cartons firmly in place relative to one another and resist such shearing force which would reasonably be applied through a difference in forces applied by vertical rollers of tax-stamping machines which roll along the exterior walls 13 of the cartons during the tax-stamping process.

Label 42 is applied across adjacent, coplanar walls of cartons 30, 32, such as bottom walls 14, to maintain the walls and hence the cartons in the same plane and adjacent one another. Label 42 may have a line of weakness 41, such as a perforated line, preferably positioned substantially parallel to the line defined by the intersection of the sticker and the plane which extends between and out from interior walls 11 (i.e., positioned between the two cartons), to facilitate a clean separation of the two cartons. Label 42 bears Universal Product Code (U.P.C.) indicia or other pricing indicia, preferably a bar code, preferably encoded for the sale of the dual carton. Additional labels (not shown), preferably without indicia, may be applied across other adjacent, coplanar walls to join the cartons together even more securely. Flaps 17 are shown as being lapped over one another in preparation to be shipped to a distributor and later opened, or, alternatively, in position for distribution to individual wholesalers or retailers for subsequent distribution to consumers.

As seen in FIG. 9, label 42*a* is placed along adjacent, coplanar walls, such as bottom walls 14, of cartons 30, 32, the lines of the bar code being positioned substantially parallel to the adjacent edges of the walls across which label 42*a* is placed. The bar code is preferably encoded for the sale of the dual carton. The bar code extends across the bottom walls of the two cartons so that when the cartons are separated the bar code is split substantially parallel to the bar code lines and only incomplete, unreadable bar code remains on each carton. Optional perforated line 41 may be included across label 42*a*, substantially parallel to the lines of the bar code and approximately above and parallel to interior walls 11.

Label 42*b*, shown in FIG. 10, is substantially the same as label 42*a*, but has an additional grip tab 44 to facilitate removal of label 42*b* so that the price coding indicia are rendered unreadable by automatic equipment upon separating the two cartons. Preferably no adhesive is applied under tab 44 so that tab 44 may be lifted easily from the walls across which label 42*b* is applied.

Label 42*c*, shown in FIG. 11 also is substantially the same as label 42*a*, but has a lift-up corner 46 (instead of tab 44 of label 42*b*) to facilitate removal of label 42*c* for separation of the two cartons. Preferably no adhesive is applied below corner 46 so that corner 46 may be lifted easily from the wall on which it rests.

Although the price coding indicia of label 42*d* of FIG. 12 are positioned similarly to the indicia of labels 42*a*, 42*b*, and 42*c* the indicia are printed directly on and across the top walls of the two five-pack cartons, instead of on a separate label/carrier means. Blank 300 is preferably used to form a dual carton with label 42*d*, although a blank such as blank 100 but with panels such as 316 and 318 (not shown) instead of panels 16 and 18 may also be used, in conjunction with a blank such as blank 100 but without panels 16 and 18.

To separate cartons 30, 32, label 42*d* must be torn so that slits 319 join to form a continuous slit, thus separating panels 316 and 318. A line of weakness such as perforated line 41 may be included to facilitate such separation.

The readily visible indicia on label 42 are preferably coded for sale of the combined ten-pack dual carton and are rendered unreadable by automatic scanning equipment upon tearing or removing label 42 to separate the two five-pack cartons. Indicia encoded for the sale of an individual carton may be printed on the walls of each of the cartons or on labels applied to the walls of the cartons. Preferably these indicia are located such that they are not readily visible when the cartons are joined. These indicia are only accessible to automatic scanning equipment after the cartons are separated.

Indicia encoded for the sale of an individual carton (not shown) may be located on the outer surface of the interior walls 11 of the cartons. In this position, these indicia are hidden when the cartons are joined to form a dual carton, and can only be scanned after the individual cartons are separated from the dual configuration.

Figure 13:
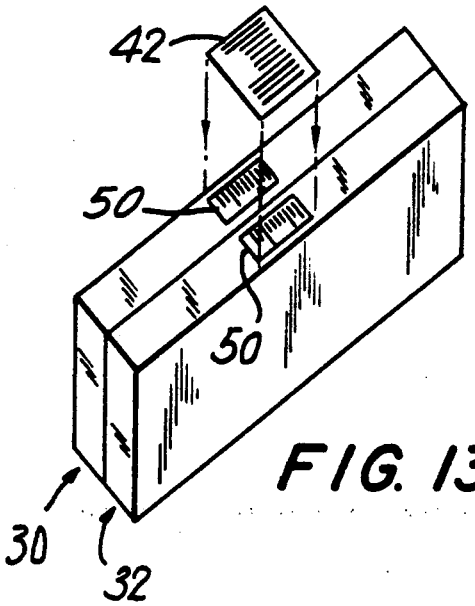
FIG. 13 is an isometric view of two five-pack cartons, each bearing price coding indicia for sale of each five-pack carton printed directly on the cartons, which cartons are to be connected with a label bearing price coding indicia for sale of a ten-pack dual carton, which label covers the indicia for fivepack carton sale.
Figure 14:
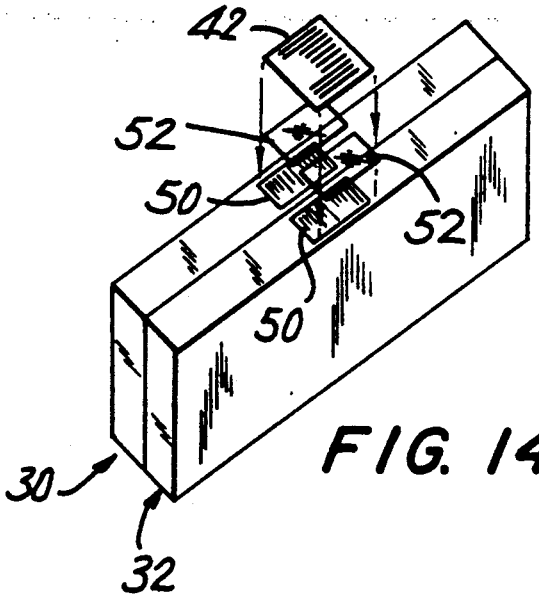
FIG. 14 is an isometric view similar to that of FIG. 13 but with clear carrier means positioned between the label and the cartons.
Figure 15:
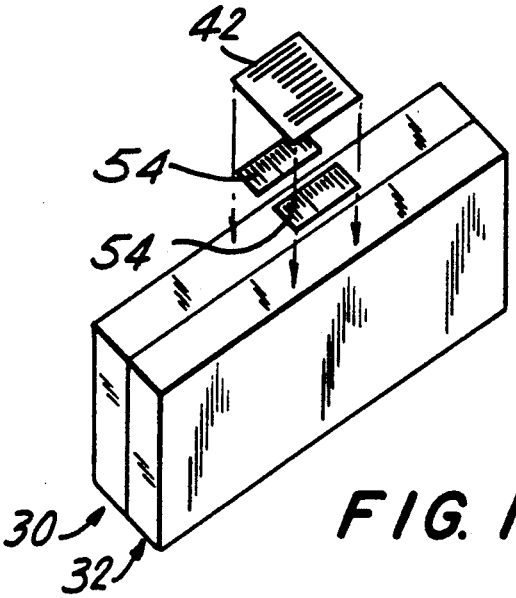
FIG. 15 is an isometric view similar to that of FIG. 13 but with the price coding indicia for sale of each five-pack printed on labels which are affixed to the cartons.

As shown in FIGS. 13–15, indicia encoded for the sale of an individual carton alternatively may be located underneath label 42 such that label 42 covers these indicia when the cartons are joined to form a dual carton. Upon separation of the two cartons, the indicia for individual sale are uncovered and can be scanned by automatic scanning equipment. Such indicia may either be printed directly on the walls of the cartons or on labels affixed to the walls of the cartons. Label 42 may optionally have a tab 44 (such as shown in FIG. 10) or a lift-up corner 46 (such as shown in FIG. 11) to facilitate removal of label 42.

FIGS. 13 and 14 reveal labels 50, bearing indicia encoded for the sale of an individual carton. Labels 50 are printed directly on the outer surface of each wall of a pair of adjacent, coplanar walls of cartons 30, 32. Label 42, bearing indicia encoded for the sale of the dual carton, is positioned over labels 50 such that labels 50 are completely covered by label 42 in the dual carton configuration. Releasable pressure-sensitive adhesive is preferably used to affix label 42 across adjacent, coplanar walls and above the indicia of labels 50 printed on these walls. Label 42 thus may be easily removed to reveal labels 50 when the dual carton is separated into its component cartons for individual sale.

Optional clear carrier means 52 may be included between label 42 and labels 50, as shown in FIG. 14. Clear carrier means 52 are secured with permanent adhesive to labels 50. Label 42 is then placed over clear carrier means 52 to cover labels 50, as discussed above. Releasable pressure-sensitive adhesive is preferably used to secure label 42 to clear carrier means 52 so that label 42 may be easily removed from the cartons to separate the dual carton into its component cartons for individual sale.

As shown in FIG. 15, indicia encoded for the sale of an individual carton may alternatively be printed on separate labels 54, one label affixed to each wall of a pair of adjacent, coplanar walls of cartons 30, 32. Label 42 is placed above labels 54 to join cartons 30, 32 and to cover labels 54 such that labels 54 are completely covered by label 42 in the dual carton configuration. Releasable pressure-sensitive adhesive is used to affix label 42 across adjacent, coplanar walls and above the indicia of labels 54 affixed to these walls, such that label 42 may be easily removed to reveal labels 54 when the dual carton is separated into its component cartons for individual sale. Permanent adhesive is preferably used to affix labels 54 to the cartons such that labels 54 are not easily removed when label 42 is removed. Clear carrier means 52 may be used between labels 54 and 42 as used between labels 50 and label 42, as discussed above.

Although label 42 is shown placed across bottom walls 14 of blanks 100 and 200, label 42 may also be placed across side walls 20 or 22, or panels 16.

Although wall 317 is referred to as a top wall, it may alternatively be referred to as a bottom wall.

Although label 42 is described as bearing indicia for automatic pricing such as U.P.C. indicia, any indicia may be used which similarly are intended to be destroyed upon separating the cartons.

Although extension panel 18 is described as tucked inside the carton, extension panel 18 may alternatively be glued to the outside of the carton.

Although flaps 17, designed to be tucked into cartons 30, 32, are shown, it will appreciated that any appropriate flap may be used, such as a flap with panel 16 without extension 18, intended to be lapped over the top of the carton, but not tucked partially inside the carton.

Although cartons 30, 32 are described as each dimensioned to hold one row of five cigarette packs, they may be lengthened or shortened to hold more or fewer than five packs. Furthermore, it will be appreciated that these concepts may be applied to the connection of cartons of other configurations for which distributors commonly have processing machinery.

It will be appreciated that references to cigarette cartons and cigarette packs are not limited to only rectangular cartons and packs, but are intended to include all configurations which are available to consumers. Cigarette cartons include cartons with windows, cartons with rounded edges, and other configurations which are designed to be passed through tax-stamping equipment. Cigarette packs include such packs as oval packs, packs with rounded edges, and other non-rectangular shapes.

It will be appreciated that references to tax-stamping machinery are intended to include any existing equipment which is readily available to distributors, and modified versions.

It will be understood that the foregoing is merely illustrative of the principles of the invention, and that various modifications can be made by those skilled in the art without departing from the scope and spirit of the invention. For example, additional labels 42, but preferably without indicia, may be used along the other adjacent, coplanar, adjoining walls of cartons 30, 32 to more securely join the cartons together for tax-stamping purposes. The present embodiments are described for the purpose of illustration rather than limitation, and the present invention is limited only by the claims which follow.

What is claimed is:

1. A dual cigarette carton of dimensions compatible with tax-stamping machinery used in the automated processing of cigarette cartons, said dual cigarette carton comprising:

a first carton having four substantially vertical walls, an exterior top wall, and an exterior bottom wall; said four substantially vertical walls including an interior front wall, an exterior rear wall substantially parallel and spaced from said interior front wall, and first and second substantially rectangular exterior side walls connecting juxtaposed vertical edges of said interior front wall and said exterior rear wall;

a second carton substantially identical to said first carton, said first and second cartons positioned adjacent one another with the interior front wall of said first carton coextensive with the interior front wall of said second carton such that the borders of the interior front walls are aligned; and a label, bearing indicia encoded for the pricing of the dual carton formed from said first and second cartons, positioned across two adjacent, coplanar, exterior walls of said first and second cartons; said indicia positioned such that the indicia are rendered unreadable by automatic scanning equipment upon separating said first and second cartons.

2. The dual cigarette carton defined in claim 1 wherein said indicia borne on said label are bar code lines printed substantially parallel to the adjacent edges of the walls across which said label is positioned such that said indicia are rendered incomplete and hence unreadable by automatic scanning equipment when said first and second cartons are separated from one another for individual sale.

3. The dual cigarette carton defined in claim 2 wherein said label has a line of weakness positioned above and substantially parallel to the adjacent edges of the walls across which said label is positioned.

4. The dual cigarette carton defined in claim 3 wherein said line of weakness is a perforated line.

5. The dual cigarette carton defined in claim 1 wherein said label is a substantially flat substrate bearing adhesive, said substrate being positioned above and across said adjacent, coplanar, exterior walls with the adhesive bearing surface in operative contact with said adjacent, coplanar, exterior walls.

6. The dual cigarette carton defined in claim 5 wherein said label has a line of weakness positioned above and substantially parallel to the adjacent edges of the walls across which the label is positioned to facilitate separation of said first and second cartons and consequently render said indicia thereon unreadable.

7. The dual cigarette carton defined in claim 6 wherein said line of weakness is a perforated line.

8. The dual cigarette carton defined in claim 5 wherein said adhesive is releasable adhesive.

9. The dual cigarette carton defined in claim 8 wherein said substrate further includes a grip tab at one end thereof to facilitate removal of said label, so that said indicia thereon cannot be read.

10. The dual cigarette carton defined in claim 9 wherein said grip tab does not bear adhesive.

11. The dual cigarette carton defined in claim 8 wherein said substrate further includes a lift-up corner to facilitate removal of said label so that said indicia thereon cannot be read.

12. The dual cigarette carton defined in claim 11 wherein said lift-up corner does not bear adhesive.

13. The dual cigarette carton defined in claim 1 wherein said label is an integral part of said dual carton, said indicia being printed directly on a portion of said dual carton that bridges across two adjacent, coplanar, exterior walls of said first and second cartons.

14. The dual cigarette carton defined in claim 13 wherein said two adjacent, coplanar, exterior walls are said top walls.

15. The dual cigarette carton defined in claim 14 wherein said two adjacent, coplanar, exterior walls are formed from the same blank wherein said label is the sole portion of said blank joining said last mentioned two adjacent, coplanar, exterior walls.

16. The dual cigarette carton defined in claim 15 wherein said label has a line of weakness positioned to facilitate separation of said first and second cartons and consequently render said indicia thereon unreadable.

17. The dual cigarette carton defined in claim 16 wherein said line of weakness is a perforated line.

18. The dual cigarette carton defined in claim 1 wherein at least one exterior rear wall of said first and second cartons has a first extension along the top edge thereof, said first extension having a distal edge and being folded substantially perpendicular to said exterior rear wall and extending outwards said interior front walls of said dual carton, thereby forming said exterior top wall of at least one of said first and second cartons.

19. The dual cigarette carton defined in claim 18 wherein said first extension further includes a second extension along said distal edge of said first extension, said second extension being folded to be substantially parallel said interior front wall when said first extension is folded substantially perpendicular to said exterior wall to extend across the top of said dual carton.

20. The dual cigarette carton defined in claim 18 wherein said at least one exterior rear wall of said first and second cartons includes said exterior rear wall of both of said first and second cartons.

21. The dual cigarette carton defined in claim 18 wherein said extension extends across the tops of both of said first and second cartons to form the top wall of both said first and second cartons when said first and second cartons are positioned adjacent one another.

22. The dual cigarette carton defined in claim 21 wherein said label is printed on said top wall of both said first and second cartons such that it bridges across both cartons.

23. The dual cigarette carton defined in claim 22 wherein said label is the sole portion of said extension joining the top wall of said first carton and the top wall of said second carton formed from said extension.

24. The dual cigarette carton defined in claim 23 wherein said label has a line of weakness positioned to facilitate separation of said first and second cartons and consequently render said indicia thereon unreadable.

25. The dual cigarette carton defined in claim 24 wherein said line of weakness is a perforated line.

26. The dual cigarette carton defined in claim 1 wherein said first and second cartons are formed from separate substantially identical first and second halves of a single blank.

27. The dual cigarette carton defined in claim 26 wherein said single blank has a line of weakness along said interior front walls dividing said single blank into said separate substantially identical first and second halves.

28. The dual cigarette carton defined in claim 27 wherein said line of weakness is a perforated line.

29. The dual cigarette carton defined in claim 26 wherein each of said exterior rear walls of said first and second cartons has a first extension along the top edge thereof, each said first extension having a distal edge and being folded substantially perpendicular to its respective exterior rear wall and extending towards its respective interior front wall, thereby forming said exterior top walls of said first and second cartons.

30. The dual cigarette carton defined in claim 29 wherein at least one of said first extensions further includes a second extension along said distal edge of said first extension, said second extension being folded to be substantially parallel to said interior front wall when said first extension is folded perpendicular to the exterior wall from which it extends.

31. The dual cigarette carton defined in claim 26 wherein said single blank further includes an extension formed of two substantially identical panels, said extension located along the width of a free edge of one of said exterior rear wall, said extension being folded perpendicular to said one of said exterior rear walls and extending across the tops of both of said first and second cartons towards the other of said exterior rear walls to form said exterior top walls of said first and second cartons.

32. The dual cigarette carton defined in claim 31 wherein said label is printed directly on said extension such that said label bridges across said two substantially identical panels.

33. The dual cigarette carton defined in claim 32 wherein said extension further includes cuts between said two substantially identical panels but not across said label which bridges said panels, such that the two panels are connected solely along said label.

34. The dual cigarette carton defined in claim 33 wherein said label further includes a line of weakness joining said cuts and positioned substantially above said adjacent interior walls of said carton to facilitate separation of said first and second cartons and subsequently render said indicia thereon unreadable.

35. The dual cigarette carton defined in claim 34 wherein said line of weakness is a perforated line.

36. The dual cigarette carton defined in claim 1 wherein said first and second cartons are formed from separate substantially identical blanks.

37. The dual cigarette carton defined in claim 1 further including indicia encoded for pricing of one of said first and second cartons positioned on each of said first and second cartons such that said indicia encoded for the pricing of one of said first and second cartons are not accessible for automatic scanning when said indicia encoded for the pricing of the dual carton are still readable by automatic scanning equipment.

38. The dual cigarette carton defined in claim 37 wherein said indicia encoded for the pricing of one said first and second cartons are positioned on the interior walls of said first and second cartons.

39. The dual cigarette carton defined in claim 37 wherein said indicia encoded for the pricing of one of said first and second cartons are positioned on each of a pair of adjacent, coplanar, exterior walls.

40. The dual cigarette carton defined in claim 39 wherein said label is a substantially flat substrate bearing releasable adhesive, positioned across said pair of adjacent, coplanar, exterior walls with the adhesive-bearing surface in operative contact with said pair of walls, said label being positioned such that said label covers said indicia encoded for the pricing of one of said first and second cartons so that only the indicia which are encoded for the pricing of the dual carton are readable by automatic scanning equipment when said label is positioned across said pair of walls.

41. The dual cigarette carton defined in claim 40 wherein said substrate further includes a grip tab at one end thereof to facilitate removal of said label, so that said indicia thereon cannot be read.

42. The dual cigarette carton defined in claim 41 wherein said grip tab does not bear adhesive.

43. The dual cigarette carton defined in claim 40 wherein said substrate further includes a lift-up corner to facilitate removal of said label so that said indicia thereon cannot be read.

44. The dual cigarette carton defined in claim 43 wherein said lift-up corner does not bear adhesive.

45. The dual cigarette carton defined in claim 40 further including a clear substantially flat substrate positioned between said label and said pair of walls.

46. The dual cigarette carton defined in claim 37 wherein said indicia encoded for the pricing of one of said first and second cartons are printed directly on a wall of each of said first and second cartons.

47. The dual cigarette carton defined in claim 37 wherein said indicia encoded for the pricing of one of said first and second cartons are printed on a label which is affixed to a wall of each of said first and second cartons.

48. A method of packaging cigarette packs which are to be passed through tax-stamping machinery used in the automated processing of cigarette cartons and later may be separated into groups of cigarette packs, said method comprising:

(i) providing a first carton having four substantially vertical walls, an exterior top wall, and an exterior bottom wall; said four vertical walls including an interior front wall, an exterior rear wall substantially parallel and spaced from said interior front wall, and first and second exterior side walls connecting juxtaposed vertical edges of said interior front wall and said exterior rear wall;

(ii) providing a second carton substantially identical to said first carton;

(iii) positioning said first and second cartons adjacent one another with the interior front wall of said first carton coextensive with the interior front wall of said second carton such that the borders of the interior front walls are aligned;

(iv) then releasably attaching said first and second cartons together so that said first and second cartons will maintain their relative positions in a subsequent passage through a tax-stamping machine, said attaching step including positioning an adhesive-bearing label across two adjacent, coplanar, exterior walls of said first and second cartons with the adhesive-bearing surface in operative contact with said adjacent coplanar, exterior walls, the opposite surface of said label bearing indicia encoded for the pricing of the dual carton formed by said first and second cartons.

49. The method of claim 48 including the further step of providing the interior front walls of said first and second cartons with indicia encoded for the pricing of one of said first and second cartons, such that said indicia encoded for the pricing of one of said first and second cartons are not readily scanned by automatic scanning equipment.

50. The method of claim 48 including the further step of providing each wall of said two adjacent, coplanar, exterior walls of said first and second cartons with indicia encoded for the pricing of one of said first and second cartons.

51. The method of claim 50 wherein said step of positioning an adhesive-bearing label across said walls comprises the further step of positioning said label such that said label covers said indicia encoded for the pricing of one of said first and second cartons so that only the indicia which are encoded for the pricing of the dual carton are readable by automatic scanning equipment when said label is positioned across said pair of walls.

52. The method of claim 51 including the further step of providing a clear substantially flat substrate positioned above said indicia encoded for the pricing of one of said first and second cartons and between said label and said walls.

53. The method of claim 48 wherein said dual carton is first passed through a tax-stamping machine and then transported to a place for retail sale and then separated into two separate cartons by a step including severing said label and rendering said indicia thereon unreadable by automatic scanning equipment.

54. The method of claim 48 wherein said first and second side walls of said first and second cartons each comprise a first panel extending from said exterior rear wall and a second panel extending from said interior front wall, the first panel being folded above and over said second panel to be adjacent and substantially coextensive with said second panel, said step of positioning said first and second cartons adjacent one another further including the step of positioning the free edge of the first panel of each of said first and second side walls of said first carton opposite and adjacent the free edge of the first panel of each of said first and second side walls of said second carton.

55. A method of packaging cigarette packs which are to be passed through tax-stamping machinery used in the automated processing of cigarette cartons and later may be separated into groups of cigarette packs, said method comprising:

(i) providing a first carton having four substantially vertical walls, an exterior top wall, and an exterior bottom wall; said four vertical walls including an interior front wall, an exterior rear wall substantially parallel and spaced from said interior front wall, and first and second exterior side walls connecting juxtaposed vertical edges of said interior front wall and said exterior rear wall;

(ii) providing a second carton substantially identical to said first carton;

(iii) positioning said first and second cartons adjacent one another with the interior front wall of said first carton coextensive with the interior front wall of said second carton such that the borders of the interior front walls are aligned;

(iv) releasably attaching said first and second cartons together so that said first and second cartons will maintain their relative positions in a subsequent passage through a tax-stamping machine, said attaching step including positioning an adhesive-bearing label across two adjacent, coplanar, exterior walls of said first and second cartons with the adhesive-bearing surface in operative contact with said exterior walls;

(v) positioning at least one row of cigarette packs in said first carton and positioning at least one row of cigarette packs in said second carton, wherein each pack bears printed matter along the outer faces of the walls thereof, said printed matter permitting a front face of the pack to be distinguished from a rear face of the pack, said packs being positioned so that the front faces of each of the cigarette packs will face the front wall of the carton in which the pack is placed.

56. The method of claim 55 including the further step of providing indicia encoded for the automatic pricing of the dual carton formed by said first and second cartons, said indicia positioned on the surface of said label which does not bear adhesive, and positioned such that said indicia are rendered unreadable upon separation of said first and second cartons.

57. The method of claim 55 including the further step of providing on the outer surface of each said interior front wall indicia encoded for the pricing of one of said first and second cartons.

58. The method of claim 55 including the further step of providing each wall of said two adjacent, coplanar, exterior walls of said first and second cartons with indicia encoded for the pricing of one of said first and second cartons.

59. The method of claim 58 wherein said step of positioning an adhesive-bearing label across said walls comprises the further step of positioning said label such that said label covers said indicia encoded for the pricing of one of said first and second cartons so that only the indicia which are encoded for the pricing of the dual carton are readable by automatic scanning equipment when said label is positioned across said pair of walls.

60. The method of claim 59 including the further step of providing a clear substantially flat substrate positioned above said indicia encoded for the pricing of one of said first and second cartons and between said label and said walls.

61. The method of claim 55 wherein said first and second walls of said first and second cartons each comprise a first panel extending from said exterior rear wall and a second panel extending from said interior front wall, the first panel being folded above and over said second panel to be adjacent and substantially coextensive with said second panel, said step of positioning said first and second cartons adjacent one another further including the step of positioning the free edge of the first panel of each of said first and second side walls of said first carton opposite and adjacent the free edge of the first panel of each of said first and second side walls of said second carton.

* * * * *